US011641066B2

(12) United States Patent
Ioffe

(10) Patent No.: US 11,641,066 B2
(45) Date of Patent: May 2, 2023

(54) ANTENNA

(71) Applicant: Aptiv Technologies Limited, St. Michael (BB)

(72) Inventor: Alexander Ioffe, Dublin (IE)

(73) Assignee: Aptiv Technologies Limited, St. Michael (BB)

( * ) Notice: Subject to any disclaimer, the term of this patent is extended or adjusted under 35 U.S.C. 154(b) by 0 days.

(21) Appl. No.: 17/931,009

(22) Filed: Sep. 9, 2022

(65) Prior Publication Data

US 2023/0072642 A1 Mar. 9, 2023

(30) Foreign Application Priority Data

Sep. 9, 2021 (EP) ..... 21195818

(51) Int. Cl.

| | |
|---|---|
| ***H01Q 21/20*** | (2006.01) |
| ***H01Q 19/10*** | (2006.01) |
| ***H01Q 13/10*** | (2006.01) |
| ***H01Q 21/00*** | (2006.01) |

(52) U.S. Cl.

CPC ..... *H01Q 21/20* (2013.01); *H01Q 13/10* (2013.01); *H01Q 19/102* (2013.01); *H01Q 21/0056* (2013.01)

(58) Field of Classification Search

CPC .. H01Q 13/10; H01Q 19/102; H01Q 21/0056; H01Q 21/20

See application file for complete search history.

(56) References Cited

U.S. PATENT DOCUMENTS

| | | | | |
|---|---|---|---|---|
| 4,112,431 | A * | 9/1978 | Wild | H01Q 3/242 343/768 |
| 10,673,123 | B2 | 6/2020 | Gottwald et al. | |
| 2008/0088519 | A1 | 4/2008 | Quan et al. | |
| 2016/0072191 | A1* | 3/2016 | Iwai | H01Q 21/005 343/771 |
| 2020/0041612 | A1 | 2/2020 | Harrison | |
| 2022/0384942 | A1* | 12/2022 | Li | G01S 13/931 |

FOREIGN PATENT DOCUMENTS

| | | |
|---|---|---|
| DE | 102014208389 | 11/2015 |
| DE | 102016222474 | 5/2018 |
| DE | 102018222528 | 6/2020 |
| EP | 1309882 | 12/2004 |
| EP | 2830156 | 1/2015 |

(Continued)

OTHER PUBLICATIONS

"Extended European Search Report", EP Application No. 22160903.5, dated Aug. 30, 2022, 8 pages.

(Continued)

*Primary Examiner* — Andrea Lindgren Baltzell
*Assistant Examiner* — Amal Patel
(74) *Attorney, Agent, or Firm* — Colby Nipper PLLC

(57) ABSTRACT

Disclosed are aspects of an antenna including a body having a convex surface. A conductive structure is deposited onto an antenna region of the convex surface. The conductive structure is configured as a conformal slot antenna array. The antenna region of the convex surface includes corrugations having peaks and valleys. A plurality of slots of the conformal slot antenna array are located at the peaks and the valleys of the convex surface.

14 Claims, 2 Drawing Sheets

(56) References Cited

FOREIGN PATENT DOCUMENTS

| | | |
|---|---|---|
| EP | 2993733 | 3/2016 |
| EP | 3477770 | 5/2019 |
| KR | 102033311 | 6/2015 |
| SE | 1930410 | 6/2021 |
| WO | 2018035148 | 2/2018 |
| WO | 2021058450 | 4/2021 |

OTHER PUBLICATIONS

"Extended European Search Report", EP Application No. 21195818.6, dated Mar. 14, 2022, 7 pages.
"Schweizer Electronic AG: 360° all-round visibility in real time thanks to 3D radar sensors for fully autonomous driving", https://www.dgap.de/dgap/News/corporate/schweizer-electronic-allround-visibility-real-time-thanks-radar-sensors-for-fully-autonomous-driving/?newsID=1429296, Mar. 22, 2021, 2 pages.
Darimireddy, et al., "Perspectives of Convertors and Communication Aspects in Automated Vehicles, Part 2: Printed Antennas and Sensors for Automotive Radars", Mar. 2021, 15 pages.
Iwai, et al., "Feasibility Study on a Slot Array in the Millimeter-Wave Band Based on a Conformal Waveguide", Nov. 2015, 3 pages.
Mayer, et al., "Conformal Antennas for a Wide View Angle in Automotive Radar", Mar. 2019, 4 pages.
Nguyen, et al., "Manufacturing of Conformal RF Antenna Modules Compression Molding", Apr. 2019, 4 pages.
Stateczny, et al., "The Empirical Application of Automotive 3D Radar Sensor for Target Detection for an Autonomous Surface Vehicle's Navigation", May 2019, 18 pages.

* cited by examiner

ANTENNA

INCORPORATION BY REFERENCE

This application claims priority to European Patent Application Number EP21195818.6, filed Sep. 9, 2021, the disclosure of which is incorporated by reference in its entirety.

BACKGROUND

In recent years, interest has grown in using conformal antennas in automotive radar sensor systems. Conformal antennas offer the potential to provide a very wide-angle view, e.g., an azimuth field of view (FoV) greater than 180 degrees. As such, radar detection around a vehicle may be achieved using a reduced number of antenna arrays. For instance, with azimuth FoV >180°, a complete 360° coverage around a vehicle could be achieved with four antenna located in the corners of the vehicle body. As such, sensor system integration into the vehicle may be simplified.

Conventional conformal antennas typically include a plurality of flat antenna elements mounted onto a three-dimensional body to form a shaped array. However, the need to form the elements individually, and then mount them to a support, means that the overall construction is relatively bulky. To address this, recent investigations have looked at forming an antenna array on a flexible substrate, and then fixing the substrate onto a moulded conformal object. However, ensuring bonding of the laminated structure may be difficult in practical applications, and it is limited by the flexibility and characteristics of the substrate. Consequently, in-vehicle integration is more restrictive and ultimately real-world performance is compromised.

The present disclosure is therefore directed to addressing issues with conventional arrangements.

SUMMARY

The present disclosure relates to an antenna and, in particular, conformal antennas such as for automotive applications. The present disclosure is particularly relevant to, for example, automotive radar sensors and conformal antenna arrays for a wide view angle radar system.

According to a first aspect there is provided an antenna including: a body having a convex surface; a conductive structure deposited onto an antenna region of the convex surface, the conductive structure configured as a conformal slot antenna array; wherein the antenna region of the convex surface includes corrugations having peaks and valleys, and wherein a plurality of slots of the conformal slot antenna array are located on the peaks or valleys of the convex surface.

In this way, an improved conformal antenna may be provided in which the antenna structure is integrated into the surface profile of the metalized body for providing both multibounce mitigation and a wide field of view. At the same time, the conformal shape allows for easier matching to the shape of vehicle parts.

In embodiments, the body is a cylindrical body.

In embodiments, the cylindrical body is a non-circular cylindrical body.

In embodiments, the non-circular cylindrical body includes congruent bases, wherein the congruent bases are one of elliptical bases or stadium bases.

In embodiments, the plurality of slots of the slot antenna array includes a first plurality of slots located on the peaks of the corrugations of the convex surface, or corrugated surface, and a second plurality of slots located in the valleys of the corrugated surface. In this way, phase compensation may be provided by the provision of slots at different surface depths.

In embodiments, the conformal slot antenna array is a substrate integrated waveguide (SIW) conformal slot antenna array.

In embodiments, the conformal slot antenna array is configured for an operating wavelength, and wherein a depth of the valleys relative to the peaks is half the operating wavelength. In this way, multibounce mitigation may be optimized, or at least improved. It will be understood that, in other embodiments, depth of the valleys relative to the peaks may be adjusted by the surface design.

In embodiments, the corrugations of the antenna region of the convex surface further include lateral wave formations in the peaks and valleys such that adjacent slots on common peaks are offset. In this way, antenna element coupling may be reduced, if not minimised.

In embodiments, the corrugations are vertical.

In embodiments, the antenna further includes a circuit board for operating the conformal slot antenna array, and wherein the circuit board is located at a circuit board region of the body diametrically opposite to the antenna region. In this way, a more compact antenna arrangement may be provided.

In embodiments, the body has a width larger than a width of the circuit board. In this way, a more compact circuit board may be used since the size antenna array is realised by the body.

In embodiments, the body is formed of a polymer, and the conductive structure is formed as a metalized structure onto the polymer body.

In embodiments, a subset of slots in the slot antenna array are independently operable.

In embodiments, the subset of slots includes a plurality of slots (or multiple slots) from one or more rows of slots for a wide elevation field of view.

In embodiments, the antenna is an automotive antenna.

In embodiments, the antenna further includes a mounting for mounting the body to at least one of a headlamp cavity, a bumper cavity, or a vehicle side mirror unit.

BRIEF DESCRIPTION OF THE DRAWINGS

Illustrative embodiments will now be described with reference to the accompanying drawings in which.

DETAILED DESCRIPTION

Figure 1:
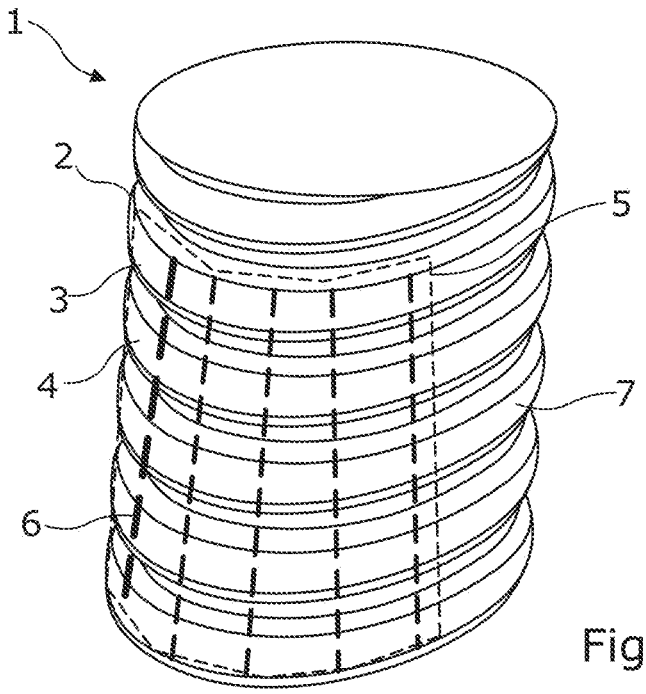
FIG. 1 shows a perspective view of an antenna according to a first embodiment.
Figure 2:
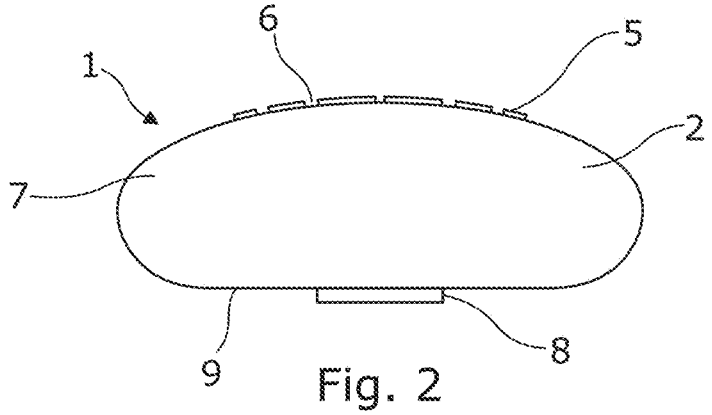
FIG. 2 shows a top view of the antenna shown in FIG. 1.
Figure 3:
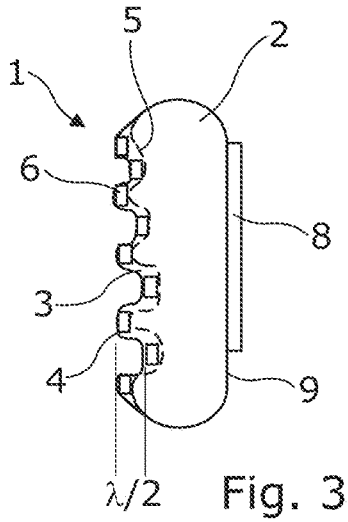
FIG. 3 shows a side cross-sectional view of the antenna shown in FIG. 1.

An antenna 1 according to a first illustrative embodiment is shown in FIGS. 1 to 3, with FIG. 1 showing a perspective view, and FIGS. 2 and 3 showing top and side cross-sectional views, respectively.

The antenna 1 includes a polymer cylindrical body 2. As shown in the top view of FIG. 2, the body 2 has non-circular bases, with a curved convex face 7. In this embodiment, the bases of the cylinder are generally elliptical, albeit with a flattened face 9 opposite to the convex face 7. In this embodiment, the cylindrical body 2 is a moulded body.

The curved, convex face 7 of the cylindrical body 2 is provided with corrugated surface formations formed of horizontal peaks 4 and valleys 3, running laterally, perpendicular to the body's axis. As such, an undulating, sinusoidal surface profile is provided when viewed in cross-section, as shown in FIG. 3. The corrugations are moulded or machined into the convex face 7 and are shown more pronounced in FIGS. 1 and 3 for illustration only. In practice, as shown in FIG. 3, the depth of the valleys 3 relative to the peaks 4 in this embodiment are half the operating wavelength of the antenna. Consequently, for automotive radar applications operating in the millimetre range (e.g., 2-10 mm), the corrugations will typically be between 1-5 mm deep.

In an embodiment, the corrugated surface is formed of peaks 4 and valleys 3, running vertically, parallel to the cylinder axis.

A plurality of slots 6 are provided in the upper surface of the metalized structure 5 and form the emitter and receivers of the antenna array. The slots 6 may be arranged in rows and columns, with the rows aligned along the valleys 3 and peaks 4 of the corrugated surface, as shown in FIG. 3. As shown in FIG. 2, the rows of slots 6 extend laterally around the curved surface so that the antenna elements associated with the slots 6 have a spread field of view.

The circuit board 8 supports the circuitry for operating the antenna array. Consequently, the size of the circuit board 8 may be minimised as it merely needs to support the operating components, with the body 2 providing the necessary width to achieve angular resolution.

In use, the antenna elements within the array are driven by the circuitry on the circuit board 8 to emit and receive radar signals. The provision of the corrugated surface, with the valleys 3 and peaks 4 distanced by half a wavelength, acts to mitigate multibounce. Consequently, the antenna 1 may be located behind another panel, whilst minimising bounce back from the panel. That is, the signal distortion that would otherwise occur may be mitigated, thereby reducing unwanted impact of the resultant radar perception. Furthermore, the provision of slots 6 in both the valleys 3 and peaks 4 provides for phase compensation.

The convex face 7 of the body allows the electromagnetic waves to propagate laterally more effectively. That is, in a flat antenna array, the edges of the antenna board will effectively limit the field of view. Accordingly, by bending the array away over a convex surface, a wider field of view, even above 180°, may be achieved. In addition, in this embodiment, the lateral spread of slots 6 over the convex face 7 allows adjacent antenna elements to have slightly different fields of view, thereby improving resolution over a broader field of view.

Figure 4:
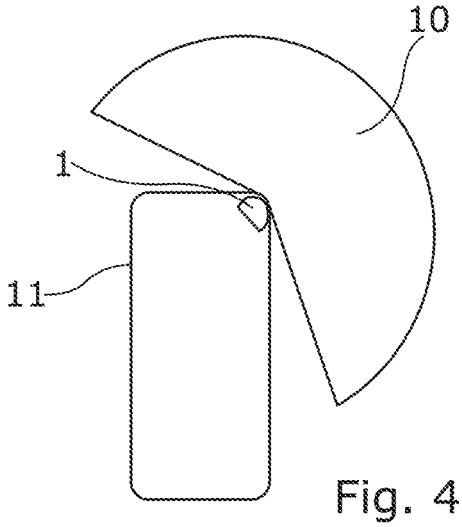
FIG. 4 shows a schematic top view of the antenna shown in FIG. 1 incorporated into the corner of a vehicle.

FIG. 4 shows a schematic top view of the antenna 1 shown in FIG. 1 incorporated into the front, right corner of a vehicle 11. As shown, the azimuth field of view can be achieved greater than 180°, thereby allowing the antenna 1 to cover an area extending from in front of the vehicle and spanning around substantially the whole vehicle's right side. Consequently, a system including four antennas located in the four corners of the vehicle 11, for example in the cavity behind the bumper panels, would be able to provide 360° radar coverage around the whole exterior of the vehicle.

It will be understood that the antenna may also be incorporated in other parts of the vehicle, such as the corners of the vehicle's headlamps or under the side mirrors. The body 2 may be fixed to the vehicle in these locations using mountings (not shown), thereby allowing the antenna 1 to be easily and discretely secured. For example, in embodiments where the body 2 is mounted within the interior cavity of as vehicle's headlamps, an opaque area may be provided on the exterior headlamp surface to hide the antenna.

Figure 5:
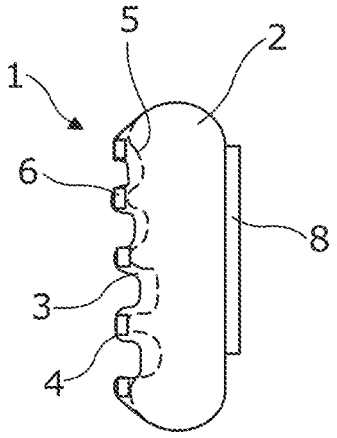
FIG. 5 shows a side cross-sectional view of an antenna according to a second embodiment.

FIG. 5 shows a side cross-sectional view of an antenna according to a second embodiment. This embodiment is substantially the same as the first embodiment, except that the slots 6 in this embodiment are provided only on the peaks 4. Alternatively, embodiments may be provided where slots are only located in valleys.

Figure 6:
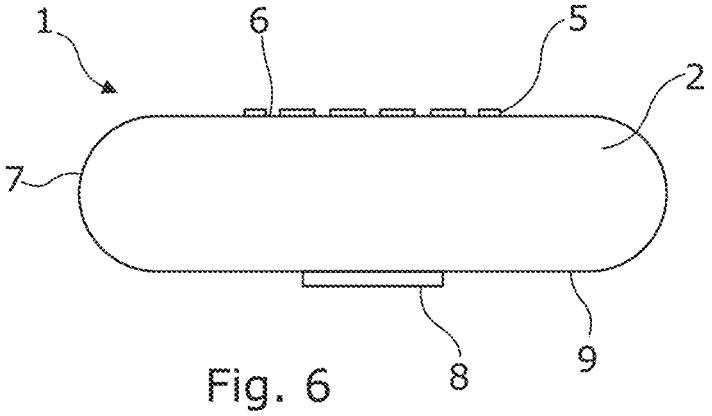
FIG. 6 shows a top view of an antenna according to a third embodiment.

FIG. 6 shows a top view of an antenna according to a third embodiment. Again, this embodiment is substantially the same as the first embodiment, except that the bases of the cylindrical body 2 in this case are stadium shaped. As such, the front face 7 still forms a convex face 7, albeit with a flattened front section upon which the metalized structure 5 forming the antenna array is provided. As such, the antenna array is provided in a planar arrangement, with the curved ends of the body 2 allowing for a relatively wide field of view. That said, as the antenna elements in the planar array will have similar fields of view, angle finding using this arrangement is relatively simplified compared to the curved array of the first embodiment.

Figure 7:
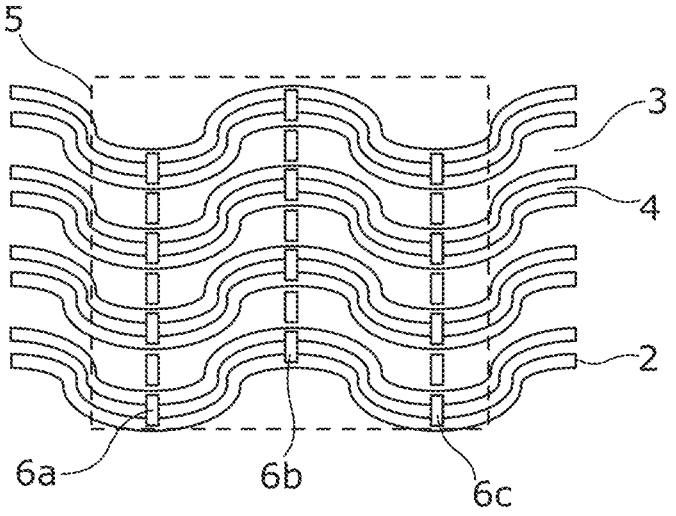
FIG. 7 shows a front view of an antenna region of an antenna according to a fourth embodiment.

FIG. 7 shows a front view of an antenna region of an antenna according to a fourth embodiment. In this arrangement, the valleys 3 and peaks 4 are provided with a undulating or wavy profile in a horizontal direction. As such, adjacent columns of slots 6 are vertically offset from one another. As such, across a row of slots on the same valley or peak, alternate slots 6*a* and 6*b* and 6*c* are provided in the same horizontal plane, with the intervening slots provided in a different horizontal plane. This may thereby reduce coupling between antenna elements.

With the above arrangements, an improved antenna may thereby be provided, with the conformal shape allowing for easier matching to the shape of vehicle parts. At the same time, the antenna array structure is integrated into the surface profile of the body to provide multibounce mitigation and a wide field of view. Furthermore, because the antenna structure is deposited directly onto the body, the above advantages may be achieved without needing to attach premade antenna elements onto a separate moulded body.

It will be understood that the embodiments illustrated above show applications only for the purposes of illustration. In practice, embodiments may be applied to many different configurations, the detail of which being straightforward for those skilled in the art to implement.

For example, the above arrangements have been described in the context of using the antenna elements as an array as a whole. However, in embodiments, a subset of the elements may be operated independently. For example, the field of view may be chosen as a wider elevation by selecting a reduced number of rows of slots, for shorter range applications, such as parking sensors. Oppositely, a narrow elevation using more vertical slots may be useful for providing longer range detection for adaptive cruise control or intersection analysis. Thus, the whole array may be operated to provide a narrow elevation field of view. The operating frequency of the antenna 1 may also be switched for enhancing the selection. For example, an ultra-wide band signal may be used for better short-range detection.

Furthermore, although an antenna body has been described with an undulating surface with a regular pattern, it will be understood that other surface designs are possible. For example, the surface may include different periodic and semi-periodic shapes. For example, vertical grooves may be provided.

It will also be understood that the slots may vary in size and shape and embodiments may include combinations of one or more slot variants. For instance, different size or shape slots, such as wide or tall or square slots, may be provided on the peaks or the valleys, or mixed across the peaks and the valleys. Equally, it is also possible for the slots to be provided on one of the peaks or the valleys.

Example Implementations

Example 1: An antenna comprising: a body having a convex surface; a conductive structure deposited onto an antenna region of the convex surface, the conductive structure configured as a conformal slot antenna array; wherein the antenna region of the convex surface comprises corrugations having peaks and valleys, and wherein a plurality of slots of the slot antenna array are located on the peaks or the valleys of the convex surface.

Example 2: An antenna according to example 1, wherein the body is a cylindrical body.

Example 3: An antenna according to example 2, wherein the cylindrical body is a non-circular cylindrical body.

Example 4: An antenna according to example 3, the non-circular cylindrical body comprises congruent bases, wherein the congruent bases are one of elliptical bases and stadium bases.

Example 5: An antenna according to any preceding example, wherein the plurality of slots of the slot antenna array comprise a first plurality of slots located on the peaks of the corrugated surface and a second plurality of slots located in the valleys of the corrugated surface.

Example 6: An antenna according to any preceding example, wherein the conformal slot antenna array is a substrate integrated waveguide, SIW, conformal slot antenna array.

Example 7: An antenna according to any preceding example, wherein the conformal slot antenna array is configured for an operating wavelength, and wherein a depth of the valleys relative to the peaks is half the operating wavelength.

Example 8: An antenna according to any preceding example, wherein the corrugations further comprise lateral wave formations in the peaks and valleys such that adjacent slots on common peaks are offset.

Example 9: An antenna according to any preceding example, further comprising a circuit board for operating the conformal slot antenna array; wherein the circuit board is located at a circuit board region of the body diametrically opposite to the antenna region.

Example 10: An antenna according to example 9, wherein the body has a width larger than a width of the circuit board.

Example 11: An antenna according to any preceding example, wherein the body is formed of a polymer, and the conductive structure is formed as a metalized structure onto the polymer body.

Example 12: An antenna according to any preceding example, wherein a subset of slots in the slot antenna array are independently operable.

Example 13: An antenna according to example 12, wherein the subset of slots comprise a plurality of slots from one or more rows of slots for a wide elevation field of view.

Example 14: An antenna according to any preceding example, wherein the antenna is an automotive antenna.

Example 15: An antenna according to example 14, further comprising a mounting for mounting the body to one of a headlamp cavity, a bumper cavity, and a vehicle side mirror unit.

What is claimed is:

1. An antenna comprising:

a body having a convex surface; and a conductive structure deposited onto an antenna region of the convex surface, the conductive structure configured as a conformal slot antenna array, wherein:

the antenna region of the convex surface comprises corrugations having peaks and valleys, and a plurality of slots of the conformal slot antenna array are located at the peaks and the valleys of the convex surface; and the plurality of slots of the conformal slot antenna array comprises:

a first plurality of slots located on the peaks of the corrugations of the convex surface; and a second plurality of slots located in the valleys of the corrugations of the convex surface.

2. The antenna according to claim 1, wherein the body is a cylindrical body.

3. The antenna according to claim 2, wherein the cylindrical body is a non-circular cylindrical body.

4. The antenna according to claim 3, wherein the non-circular cylindrical body comprises congruent bases, and the congruent bases are one of elliptical bases or stadium bases.

5. The antenna according to claim 1, wherein the conformal slot antenna array is a substrate integrated waveguide (SIW) conformal slot antenna array.

6. The antenna according to claim 1, wherein the conformal slot antenna array is configured for an operating wavelength, and a depth of the valleys relative to the peaks is half the operating wavelength.

7. The antenna according to claim 1, wherein the corrugations of the convex surface comprise lateral wave formations in the peaks and valleys such that adjacent slots on common peaks are offset.

8. The antenna according to claim 1, further comprising:

a circuit board configured to operate the conformal slot antenna array, wherein the circuit board is located at a circuit board region of the body diametrically opposite to the antenna region.

9. The antenna according to claim 8, wherein the body has a width larger than a width of the circuit board.

10. The antenna according to claim 1, wherein the body is formed of a polymer, and the conductive structure is formed as a metalized structure onto the polymer of the body.

11. The antenna according to claim 1, wherein a subset of slots in the conformal slot antenna array are independently operable.

12. The antenna according to claim 11, wherein the subset of slots comprises multiple slots from one or more rows of slots for a wide elevation field of view.

13. The antenna according to claim 1, wherein the antenna is an automotive antenna.

14. The antenna according to claim 13, further comprising:

a mounting configured to mount the body to at least one of a headlamp cavity, a bumper cavity, or a vehicle side mirror unit.

* * * * *